US012529004B2

(12) United States Patent
Shamszad et al.

(10) Patent No.: US 12,529,004 B2
(45) Date of Patent: Jan. 20, 2026

(54) METHOD TO MINIMIZE CONDUCTIVE DEPOSITS

(71) Applicant: The Lubrizol Corporation, Wickliffe, OH (US)

(72) Inventors: Mariam Shamszad, Willoughby, OH (US); William D. Abraham, Concord Township, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 18/854,572

(22) PCT Filed: Mar. 22, 2023

(86) PCT No.: PCT/US2023/015874
§ 371 (c)(1),
(2) Date: Oct. 7, 2024

(87) PCT Pub. No.: WO2023/196116
PCT Pub. Date: Oct. 12, 2023

(65) Prior Publication Data

US 2025/0277162 A1 Sep. 4, 2025

Related U.S. Application Data

(60) Provisional application No. 63/327,974, filed on Apr. 6, 2022.

(51) Int. Cl.

| | |
|---|---|
| ***C10M 139/00*** | (2006.01) |
| ***C10M 135/36*** | (2006.01) |
| ***C10M 141/12*** | (2006.01) |
| *C10N 30/06* | (2006.01) |
| *C10N 40/14* | (2006.01) |

(52) U.S. Cl.
CPC ..... *C10M 139/00* (2013.01); *C10M 135/36* (2013.01); *C10M 141/12* (2013.01); *C10M 2219/106* (2013.01); *C10M 2227/062* (2013.01); *C10N 2030/06* (2013.01); *C10N 2040/14* (2013.01)

(58) Field of Classification Search
CPC ..... C10M 139/00; C10M 135/36; C10M 141/12; C10M 2219/106; C10M 2227/062; C10N 2030/06; C10N 2040/14
USPC ..... 508/185, 273
See application file for complete search history.

(56) References Cited

U.S. PATENT DOCUMENTS

| | | | | |
|---|---|---|---|---|
| 10,640,723 | B2 | 5/2020 | Fang | |
| 2005/0014656 | A1* | 1/2005 | Sumiejski | C10M 157/10 508/192 |
| 2008/0194442 | A1* | 8/2008 | Watts | C10M 141/10 508/110 |
| 2008/0248980 | A1* | 10/2008 | Sumiejski | C10M 169/045 508/156 |
| 2010/0130390 | A1* | 5/2010 | Tipton | C10M 141/10 508/273 |
| 2014/0100147 | A1* | 4/2014 | Hoshino | C10M 141/12 508/185 |
| 2017/0283731 | A1* | 10/2017 | Gao | C10M 141/12 |
| 2020/0216774 | A1* | 7/2020 | Abraham | C10M 163/00 |

FOREIGN PATENT DOCUMENTS

| | | |
|---|---|---|
| EP | 3668959 | 6/2020 |

* cited by examiner

*Primary Examiner* — Ellen M Mcavoy
(74) *Attorney, Agent, or Firm* — Joseph Svarovsky; Christopher P. Demas; Michael A. Miller

(57) ABSTRACT

The disclosed technology relates to a method of minimizing electrically conductive deposits in an electrically conducting apparatus by lubricating the apparatus with a lubricant containing a borate ester.

18 Claims, No Drawings

METHOD TO MINIMIZE CONDUCTIVE DEPOSITS

CROSS REFERENCE TO RELATED APPLICATION

This application claims priority from PCT Application Serial No. PCT/US23/015874 filed on Mar. 22, 2023, which claims the benefit of U.S. Provisional Application No. U.S. 63/327,974 filed on Apr. 6, 2022, the entirety of which is hereby incorporated by reference.

The disclosed technology relates to a method of minimizing electrically conductive deposits in an electrically conducting apparatus while providing sufficient wear protection by lubricating the apparatus with a lubricant containing a borate ester and a thiadiazole corrosion inhibitor.

Advances in hybrid and electric vehicles have created a need for a new generation of lubricants and new lubricant performance tests. Copper corrosion is one prominent concern for hybrid and electric vehicles and is routinely assessed using a coupon test. In the presence of a lubricating fluid that is corrosive in nature, the appearance of the copper coupon can change due to metal dissolution, a surface tarnish, or formation of a corrosion layer. The visual rating provided at the end of the test is qualitative in nature and does not provide insight into the type of corrosion process that is occurring, or the chemical kinetics or time dependence of the corrosion process.

WO2021/155015 describes the development of a copper wire test that was designed to generate corrosion test results in real-time and simultaneously in the solution and vapor phase. In this test, a known constant current or voltage is passed through a wire with a given thickness and length. The electrical resistance of the wire can be measured over time and at varying temperatures. If metal dissolution is the cause of corrosion, the resistance measured will increase over time as the wire thins and finally breaks.

In an electric drive unit, there are multiple sources of electric potential present which can significantly alter the formation of a corrosion deposit. Use of the conductive layer deposit test described herein may help to determine if the corrosive mechanism for the fluid is due to formation of a corrosion deposit. In this test, copper printed circuit boards (PCBs) are immersed in the solution phase of a lubricant and positioned in the vapor phase above the lubricant as a current is passed through the lubricating fluid. Real-time conductance measurements are made and visual observations of the appearance of a printed circuit board at the end of the test are utilized to determine if a corrosion deposit forms and if that deposit is conductive or non-conductive.

A conductive layer deposit is defined as the formation of solids created by corrosion or lubricant degradation byproducts which form an unwanted path of low electrical resistance. The chemical identity of these layers has been investigated and determine to be copper sulfide. Formation of this conductive deposit may result in catastrophic failure of the electric drive unit, either through direct shorting of the motor windings or failure of the power electronics. While this phenomenon is a new area of concern for electric motors and lubricants, the microelectronics industry has evaluated similar phenomena in printed circuit board (PCB) failures since the early 1970s. FIG. 14 on page 7 of Hunt, G. and Prengaman, C., "Understanding Vapor and Solution Phase Corrosion of Lubricants Used in Electrified Transmissions," SAE Technical Paper 2020-01-0561, 2020, doi:10.4271/2020-01-0561, shows a failure of an electric motor due to a conductive deposit causing a short between the electric motor windings.

Metal corrosion can be a costly and destructive phenomenon. In 2017, it was estimated that the total global cost of environmental corrosion of iron was $2.5 trillion annually, when the market share of plug-in vehicles was exceptionally low. The addition of an electric motor in electric vehicles brings with it an increased opportunity for metal corrosion to occur. Corrosion of copper found in the electrical components may add significant cost to the FIGURE cited above. With the increase in electric vehicle sales, corrosion-related impacts on electric vehicles can have an impact on the total cost of corrosion both locally and globally.

Different drivetrain formulations may have inherently varying corrosion rates producing conductive layer deposits in both solution and vapor phases. In some vehicles, an electric motor will be incorporated into the transmission or axle and will be in direct contact with the lubricant, in others, the pathway between the lubricant and the electric motor will be limited to the vapor space. Formation of conductive layer deposits has been identified as a failure mechanism for current electric motor designs. One of the long standing challenges in lubrication science is to provide adequate corrosion protection while providing sufficient wear protection. The wide variety of electric motor and transmission design combinations make it imperative to have a robust method to minimize or prevent conductive deposits while providing sufficient wear protection.

The disclosed technology, therefore, solves the problem of conductive deposits in an electrically conducting apparatus.

SUMMARY

The disclosed technology provides a method of minimizing electrically conductive deposits in an electrically conducting apparatus. The method includes applying to said apparatus a lubricant containing an oil of lubricating viscosity and from 0.3 to 1 wt. % borate ester and applying an electrical current. In some embodiments, the lubricant in the method can also contain from 0.01 to 1.0 percent by weight of a thiadiazole compound. The method helps to maintain a wear rating according to ASTM D5182 at 150° C. of greater than 10.

DETAILED DESCRIPTION

Various preferred features and embodiments will be described below by way of non-limiting illustration.

One component of the disclosed technology is an oil of lubricating viscosity, also referred to as a base oil. The base oil may be selected from any of the base oils in Groups I-V of the American Petroleum Institute (API) Base Oil Interchangeability Guidelines (2011), namely

| Base Oil Category | Sulfur (%) | Saturates(%) | Viscosity Index |
|---|---|---|---|
| Group I | >0.03 and/or | <90 | 80 to less than 120 |
| Group II | ≤0.03 and | ≥90 | 80 to less than 120 |
| Group III | ≤0.03 and | ≥90 | ≥120 |
| Group IV | All polyalphaolefins (PAOs) | | |
| Group V | All others not included in Groups I, II, III or IV | | |

Groups I, II and III are mineral oil base stocks. Other generally recognized categories of base oils may be used, even if not officially identified by the API: Group II+, referring to materials of Group II having a viscosity index of 110-119 and lower volatility than other Group II oils; and Group III+, referring to materials of Group III having a viscosity index greater than or equal to 130. The oil of lubricating viscosity can include natural or synthetic oils and mixtures thereof. Mixture of mineral oil and synthetic oils, e.g., polyalphaolefin oils and/or polyester oils, may be used. In one embodiment the oil of lubricating viscosity comprises an API group II or Group III oil or mixtures thereof.

The oil of lubricating viscosity (or mixture of such oils) can be a relatively low viscosity oil, having a kinematic viscosity at 100° C. of 2.2 to 3.7 mm2/s, or 2.5 to 3.5 mm2/s, or 2.8 to 3.3 mm2/s. The use of oil of this viscosity range permits preparation of a lubricant composition having a kinematic viscosity at 100° C. of less than or equal to 4.7 mm2/s, such as 3.0 to 4.6 or 3.3 to 4.3 or 3.6 to 4.1 mm2/s.

The amount of the oil of lubricating viscosity may be 50 to 98 percent by weight, or 60 to 96, or 70 to 94, or 80 to 93, or 85 to 92 percent by weight. The amount may be calculated so as to include the amount of diluent oil conventionally supplied with such additive components as detergents, dispersants, and viscosity modifiers.

Another component of the disclosed lubricant composition is at least one borate ester having an alkyl group of 4 to 18 carbon atoms. Borate ester may be seen generically as ester from boric acid or an equivalent thereof with an alcohol.

In one embodiment the boron-containing compound may be described as a borate ester or a borate alcohol. The borate ester or borate alcohol compounds are substantially the same except the borate alcohol has at least one hydroxyl group that is not esterified. Therefore, as used herein the term "borate ester" is used to refer to either borate ester or borate alcohol.

The borate ester may be prepared by the reaction of a boron compound and at least one compound selected from halohydrin compounds, epihalohydrin compounds, alcohols and mixtures thereof. The alcohols include dihydric alcohols, trihydric alcohols or higher alcohols, with the proviso for one embodiment that hydroxyl groups are on adjacent carbon atoms, i.e., vicinal.

Boron compounds suitable for preparing the borate ester include the various forms such as boric acid (including metaboric acid, HBO2, orthoboric acid, H3BO3, and tetraboric acid, H2B4O7), boric oxide, boron trioxide and alkyl borates. The borate ester may also be prepared from boron halides.

In one embodiment the borate ester is formed by the reaction of a boron compound with dihydric alcohols, trihydric alcohols or higher alcohols. The borate ester may be represented by at least one of formulas (I) to (VI):

(I)

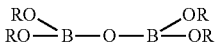

(II)

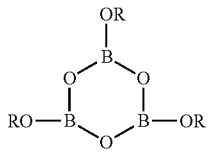

-continued (III)

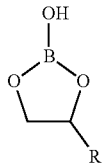

(IV)

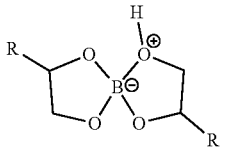

(V)

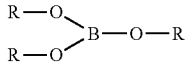

(VI)

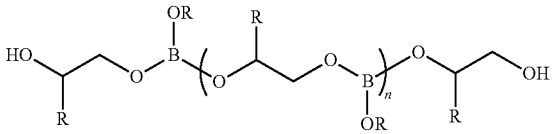

wherein each R may be hydrogen or a hydrocarbyl groups, provided that the borate ester is oil soluble.

In one embodiment at least two of the R groups per the above formulas are hydrocarbyl groups. The hydrocarbyl groups may be alkyl, aryl or cycloalkyl, wherein when any two adjacent R groups are connected in a ring. When R is alkyl, the group may be saturated or unsaturated. In one embodiment the hydrocarbyl group is an unsaturated alkyl. In one embodiment the hydrocarbyl group is cyclic. In one embodiment the hydrocarbyl groups are mixtures of alkyl and cycloalkyl.

The number of carbon atoms present in each R may be 4 to 18 or 6 to 12. In certain embodiments the total number of carbon atoms on the R groups typically may be 9 or more, or about 10 or more, or about 12 or more, or about 14 or more.

Examples of R groups include isopropyl, n-butyl, isobutyl, amyl, 2-pentenyl, 4-methyl-2-pentyl, 2-ethylhexyl, heptyl, isooctyl, nonyl, decyl, undecyl, dodecenyl, dodecyl, tridecyl, tetradecyl, pentadecyl, hexadecyl, heptadecyl, and octadecyl groups.

The alcohols employed for esterification of an alcohol with a borating agent may include monohydric alcohols, dihydric alcohols, trihydric alcohols or higher alcohols. The alcohol may contain 4 to 18 carbon atoms or 6 to 16 or 6 to 12 carbon atoms.

The borate ester may be prepared by blending the boron compound and the alcohols described above and heating them at a suitable temperature, such as at 80° C. to 250° C., 90° C. to 240° C., or 100° C. to 230° C., until the desired reaction has occurred. An inert liquid may be used in performing the reaction, such as toluene, xylene, chlorobenzene, dimethylformamide, or mixtures thereof. Water is typically formed and is distilled off during a condensation reaction. Alkaline reagents may be used to catalyze the reaction.

In one embodiment suitable borate ester compounds include tripropyl borate, tributyl borate, tripentyl borate, trihexyl borate, triheptyl borate, trioctyl borate, trinonyl borate, and tridecyl borate. In one embodiment the borate ester compounds include tributyl borate, tri-2-ethylhexyl borate or mixtures thereof.

In certain embodiments the lubricant composition may comprise borate ester containing an alkyl group of 4 to 12 carbon atoms. In other embodiments the borate ester component may comprise the reaction product of boric acid with an alcohol of 6 to 12 carbon atoms.

The amount of the borate ester in the lubricant may be 0.2 to 1.1 percent by weight or 0.25 or 0.3 to 1.1 percent or 0.4 to 1 percent or 0.45 to 1 percent by weight, or 0.2 to 1 percent or 0.25 to 1 percent or 0.3 to 1 percent or 0.3 to 0.8 percent.

Another component of the disclosed lubricant composition is a thiadiazole compound. The thiadiazole may be a thiadiazole or a hydrocarbyl-substituted thiadiazole. Examples of a thiadiazole include 2,5-dimercapto-1,3,4-thiadiazole, or oligomers thereof, a hydrocarbyl-substituted 2,5-dimercapto-1,3-4-thiadiazole, a hydrocarbylthio-substituted 2,5-dimercapto-1,3-4-thiadiazole, or oligomers thereof. The oligomers of hydrocarbyl-substituted 2,5-dimercapto-1,3-4-thiadiazole typically form by forming a sulfur-sulfur bond between 2,5-dimercapto-1,3-4-thiadiazole units to form oligomers of two or more of said thiadiazole units.

Examples of a suitable thiadiazole compound include at least one of a dimercaptothiadiazole, 2,5-dimercapto-[1,3,4]-thiadiazole, 3,5-dimercapto-[1,2,4]-thiadiazole, 3,4-dimercapto-[1,2,5]-thiadiazole, or 4-5-dimercapto-[1,2,3]-thiadaizole. Typically readily available materials such as 2,5-dimercapto-1,3,4-thiadiazole or a hydrocarbyl-substituted 2,5-dimercapto-1,3-4-thiadiazole or a hydrocarbylthio-substituted 2,5-dimercapto-1,3,4-thiadiazole may be commonly utilized, with 2,5-dimercapto-[1,3,4]-thiadiazole most commonly utilized due to availability. In different embodiments the number of carbon atoms on the hydrocarbyl-substituent group includes 1 to 30, 2 to 25, 4 to 20, 6 to 16, or 8 to 10.

In one embodiment, the thiadiazole compound may be the reaction product of a phenol with an aldehyde and a dimercaptothiadiazole. The phenol includes an alkyl phenol wherein the alkyl group contains at least 6, e.g., 6 to 24, or 6 (or 7) to 12 carbon atoms. The aldehyde includes an aldehyde containing 1 to 7 carbon atoms or an aldehyde synthon, such as formaldehyde. Useful thiadiazole compounds include 2-alkyldithio-5-mercapto-[1,3,4]-thiadiazoles, 2,5-bis(alkyldithio)-[1,3,4]-thiadiazoles, 2-alkylhydroxyphenylmethylthio-5-mercapto-[1,3,4]-thiadiazoles (such as 2-[5-heptyl-2-hydroxyphenylmethylthio]-5-mercapto-[1,3,4]-thiadiazole), and mixtures thereof.

In one embodiment the thiadiazole compound includes at least one of 2,5-bis(tert-octyldithio)-1,3,4-thiadiazole, 2,5-bis(tert-nonyldithio)-1,3,4-thiadiazole, or 2,5-bis(tert-decyldithio)-1,3,4-thiadiazole. In yet another embodiment, the thiadiazole comprises at least one of 1,3,4-thiadiazole, 2,5-bis(tert-nonyldithio), 2-(heptyl hydroxyphenylmethylthio)-5-mercapto-[1,3,4]-thiadiazole, or mixtures thereof.

The amount of the thiadiazole compound in the lubricant may be 0.01 to 1.0 percent by weight or 0.02 or 0.03 to 0.9 percent or 0.04 to 0.8 percent or 0.05 to 0.7 percent by weight, or 0.06 to 0.6 percent or 0.07 to 0.5 percent.

Other conventional additives may also optionally be present in amounts conventionally used for automatic transmission lubricants. They include, for example, phosphorus ester, viscosity modifier, dispersant, foam inhibitor, friction modifier, antioxidant, detergent, corrosion inhibitor, extreme pressure/antiwear agent, and seal swell agent.

In an embodiment, the lubricant can contain at least one phosphorus ester in an amount to provide 150 to 650, or 150 to 350, or 180 to 250 parts per million by weight phosphorus to the composition. The amount of the at least one phosphorus ester will be 0.05 to 0.4 percent by weight, or 0.1 to 0.35 percent.

The phosphorus ester may comprise a C4 to C8 or C4 to C6 alkyl phosphite, such as dioctyl phosphite, or, alternatively, an oligomeric phosphite which is the reaction product of a monomeric phosphorous acid or ester with an alkylene diol.

The C4 to C6 alkyl phosphite may include dialkyl phosphites such as dibutyl phosphites, dihexyl phosphite, and dicyclohexyl phosphite. Such materials are readily commercially available.

The oligomeric phosphites are described in greater detail in PCT publication WO 2016/089565, Abraham et al. (Lubrizol), Jun. 9, 2016. In brief they may be described as a reaction product of (a) a monomeric phosphorous acid or an ester thereof with (b) at least two alkylene diols. The first alkylene diol (i) will have two hydroxy groups in a 1,4 or 1,5 or 1,6 relationship on the carbon chain, and the second alkylene diol (ii) will be an alkyl-substituted 1,3-propylene diol with one or more of the alkyl substituents on one or more of the carbon atoms of the propylene unit. The total number of carbon atoms in the alkyl-substituted 1,3-propylene diol will be 5 to 12. In the oligomeric phosphite, the relative molar amounts of monomeric phosphorous acid or ester thereof (a) and the total of the alkylene diols (b) will typically be in a ratio of about 0.9:1.1 to about 1.1:0.9 Moreover, the relative molar amounts of the first alkylene diol (i) and the alkyl-substituted 1,3-propylene diol (ii) will typically be in a ratio of 30:70 to 65:35, or alternatively 35:54 to 60:40 or 50:60 to 50:50, or 40:60 to 45:55.

The first alkylene diol may be branched (e.g., alkyl-substituted) or unbranched and in one embodiment is unbranched. Unbranched, that is, linear diols ($\alpha,\omega$-diols) include 1,4-butanediol, 1,5-pentane diol, and 1,6-hexanediol. Branched or substituted diols include 1,4-pentanediol, 2-methyl-1,5-pentanediol, 3-methyl-1,5-pentanediol, 3,3-dimethyl-1,5-pentanediol, 1,5-hexanediol, 2,5-hexanediol, and 2,5-dimethyl-2,5-hexanediol. For purposes of the disclosed technology, a diol having one or more secondary hydroxy groups (such as 2,5-hexanediol) may be referred to as a branched or substituted diol, even though the carbon chain itself may be linear. The location of the hydroxy groups in the 1,4-, 1,5-, or 1,6-positions (that is, either positions relative to each other or literal positions) may be helpful to promote oligomerization with the phosphorous species rather than formation of cyclic structures (which would be sterically disfavored). In certain embodiments the first alkylene diol may be 1,6-hexanediol.

The first alkylene dihydroxy compound (diol) may, if desired, have additional hydroxy groups, that is, more than two per molecule, or there may be exactly two. In one embodiment, there are exactly two hydroxy groups per molecule. If there are more than two hydroxy groups, care should be taken to assure that there is no excessive cyclization such as might interfere with the polymerization reaction, if there are fewer than 4 atoms separating any of the hydroxy groups. Also, care should be taken to avoid excessive branching or crosslinking in the product, which could lead to undesirable gel formation. Such problems may be avoided by careful control of reaction conditions such as control of the ratio of reagents and the order of their addition, performing the reaction under suitably dilute conditions, and reacting under low acid conditions. These conditions can be determined by the person skilled in the art with only routine experimentation.

The second alkylene diol is an alkyl-substituted 1,3-propylene diol with one or more of the alkyl substituents thereof being on one or more of the carbon atoms of the propylene unit, the total number of carbon atoms in the alkyl-substituted 1,3-propylene diol being 5 to 12 or 6 to 12 or 7 to 11 or 8 to 18 or, in certain embodiments, 9. That is, the alkyl-substituted 1,3-propylene diol may be represented by the general formula

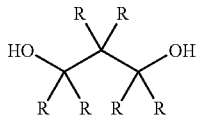

where the various R groups may be the same or different and may be hydrogen or an alkyl group, provided that at least one R is an alkyl group and that the total number of carbon atoms in the R groups is 2 to 9 or 3 to 9, so that the total carbon atoms in the diol will be 5 to 12 or 6 to 12, respectively, and likewise for the other ranges of total carbons. By analogy with the above-described, 1,4-, 1,5-, or 1,6-diols, reference here to 1,3-diols means that the two hydroxy groups are in a 1,3 relationship to each other, that is, separated by a chain of 3 carbon atoms. A 1,3-diol may thus also be named as a 2,4- or 3,5-diol. If the 1,3-diol has one or more secondary hydroxy groups, such a molecule will be considered to be a substituted diol. In one embodiment the number of alkyl substituents is 2 and the total number of carbon atoms in the molecule is 9. Suitable substituents may include, for instance, methyl, ethyl, propyl, and butyl (in their various possible isomers).

Examples of the second alkylene diol may include 2,2-dimethyl-1,3-propanediol, 2-ethyl-2-butylpropane-1,3-diol, 2-ethylhexane-1,3-diol, 2,2-dibutylpropane-1,3-diol, 2,2-diisobutylpropane-1,3-diol, 2-methyl-2-propylpropane-1,3-diol, 2-propyl-propane-1,3-diol, 2-butylpropane-1,3-diol, 2-pentylpropane-1,3-diol, 2-methyl-2-propylpropane-1,3-diol, 2,2-diethylpropane-1,3-diol, 2,2,4-trimethylpentane-1,3-diol, 2-methylpentane-2,4-diol, 2,4-dimethyl-2,4-pentanediol, and 2,4-hexanediol. It should be noted that some of the foregoing nomenclature emphasizes the propane-1,3-diol structure of the molecules, for clarity. For instance, 2-pentylpropane-1,3-diol might also be named 2-hydroxymethylheptan-1-ol, but the latter nomenclature does not so clearly illustrate the 1,3-nature of the diol.

While the one or more phosphorus esters will provide the amount of phosphorus to the lubricant composition as indicated above, the total amount of phosphorus in the lubricant may be in a higher range, such as 150 to 1000, or 200 to 800, parts per million by weight. The additional phosphorus may be provided by a different phosphorus-containing species, such as an inorganic phosphorus acid, such as phosphoric acid or phosphorous acid. Phosphoric acid may be commercially provided as an 85 percent by weight composition with 15 percent water, and appropriate amounts thereof may be employed. Other phosphorus sources may include phosphorus-treated (phosphorus-containing) dispersants such as post-treated succinimide dispersants, described below.

The lubricant composition of the disclosed technology may, in certain embodiments, further comprise a viscosity modifier, also referred to as a viscosity index modifier or a viscosity index improver. Viscosity modifiers (VMs) and dispersant viscosity modifiers (DVMs) are well known. Examples of VMs and DVMs may include polymethacrylates, polyacrylates, polyolefins, hydrogenated vinyl aromatic-diene copolymers (e.g., styrene-butadiene, styrene-isoprene), styrene-maleic ester copolymers, and similar polymeric substances including homopolymers, copolymers, and graft copolymers, including polymers having linear, branched, or star-like structures. The DVM may comprise a nitrogen-containing methacrylate polymer or nitrogen-containing olefin polymer, such as a poly(meth) acrylate containing a nitrogen-containing dispersant monomer; for example, a nitrogen-containing methacrylate polymer derived from methyl methacrylate and dimethylaminopropyl amine. The DVM may alternatively comprise a copolymer with units derived from an α-olefin and units derived from a carboxylic acid or anhydride, such as maleic anhydride, in part esterified with a branched primary alcohol and in part reacted with an amine-containing compound.

Examples of commercially available VMs, DVMs and their chemical types may include the following: polyisobutylenes (such as Indopol™ from BP Amoco or Parapol™ from ExxonMobil); olefin copolymers (such as Lubrizol® 7060, 7065, and 7067, and Lucant® HC-2000L, HC-1100, and HC-600 from Lubrizol); hydrogenated styrene-diene copolymers (such as Shellvis™ 40 and 50, from Shell and LZ® 7308, and 7318 from Lubrizol); styrene/maleate copolymers, which are dispersant copolymers (such as LZ® 3702 and 3715 from Lubrizol); polymethacrylates, some of which have dispersant properties (such as those in the Viscoplex™ series from RohMax, the Hitec™ series of viscosity index improvers from Afton, and LZ® 7702, LZR 7727, LZR 7725 and LZR 7720C from Lubrizol); olefin-graft-polymethacrylate polymers (such as Viscoplex™ 2-500 and 2-600 from RohMax); and hydrogenated polyisoprene star polymers (such as Shellvis™ 200 and 260, from Shell).

The VM or DVM may have a weight average molecular weight of 5,000 to 25,000, or 10,000 to 20,000, or 12,000 to 18,000. The number average molecular weight will be proportionally lower, such as 3,000 to 15,000, or 6,000 to 12,000. The materials in question typically have a relatively low molecular weight compared to VMs and DVMs that may be commonly used in other applications, such as lubricants for internal combustion engines.

In one embodiment the viscosity index modifier may comprise a linear polymer viscosity modifier having dispersant functionality, wherein the linear polymer has a weight average molecular weight of 5,000 to 25,000 or 10,000 to 20,000, and wherein said linear polymer is present in an amount of about 0.1 to about 4 weight percent. In one embodiment the viscosity index modifier may comprise a linear polymer as described herein and a polymer with star architecture, e.g., (meth)acrylic type star polymers, as disclosed in WO 2007/127660, Lubrizol, Nov. 8, 2007.

Viscosity modifiers that may be used are described in U.S. Pat. Nos. 5,157,088, 5,256,752 and 5,395,539. The VMs and/or DVMs may be used in the functional fluid at a concentration of up to 50% or to 20% by weight, depending on the application. Concentrations of 0.1 to 20%, or 0.5 to 20%, or 1 to 20%, or 1 to 12%, or 3 to 10%, or 0.1 to 4%, or 1 to 4%, or alternatively 20 to 40%, or 20 to 30% by weight in the lubricant composition may be used. The selection of the amount of viscosity modifier is within the abilities of the person of ordinary skill, and will be in an amount which, in combination with the viscosity of the base oil, will provide a lubricant composition with a kinematic viscosity at 100° C. of less than or equal to 4.7 mm2/s, such as 2.7 to 4.7, or 2.8 to 4.7, or 3.4 to 4.0, or 3.5 to 3.9 mm2/s.

The lubricant composition of the disclosed technology may also include one or more dispersants, such as succinimide dispersants, which in some cases may provide additional boron content to the lubricant composition. Succinimide dispersants are sometimes referred to ashless dispersants are so-called because, as supplied, they do not contain metal and thus do not normally contribute to sulfated ash when added to a lubricant (although the boron component which borated detergents contain may contribute to sulfated ash). However, ashless dispersants may, of course, interact with ambient metals once they are added to a lubricant which includes metal-containing species. Ashless dispersants are characterized by a polar group attached to a relatively high molecular weight hydrocarbon chain. Typical ashless dispersants include N-substituted long chain alkenyl succinimides, having a variety of chemical structures including typically the simplified structure

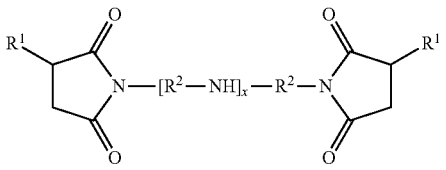

Here each $R^1$ is independently an alkyl group, frequently a polyisobutylene group with a molecular weight (Mn) of 500-5000 based on the polyisobutylene precursor, and $R^2$ are alkylene groups, commonly ethylene ($C_2H_4$) groups. Such molecules are commonly derived from reaction of an alkenyl acylating agent with a polyamine. A wide variety of linkages between the two moieties is possible beside the simple imide structure shown above, including a variety of amides and quaternary ammonium salts. Likewise, a variety of structures of the polyamine component are known to be possible, including various cyclic structures. Moreover, in the above structure, the amine portion is shown as an alkylene polyamine, although other aliphatic and aromatic mono- and polyamines may also be used. Also, a variety of modes of linkage of the $R^1$ groups onto the imide structure are possible, including various cyclic linkages. The ratio of the carbonyl groups of the acylating agent to the nitrogen atoms of the amine may be 1:0.5 to 1:3, and in other instances 1:1 to 1:2.75 or 1:1.5 to 1:2.5. Succinimide dispersants are more fully described in U.S. Pat. Nos. 4,234,435 and 3,172,892 and in EP 0355895.

Dispersants can also be post-treated by reaction with any of a variety of agents. Among these are urea, thiourea, dimercaptothiadiazoles, carbon disulfide, aldehydes, ketones, carboxylic acids, hydrocarbon-substituted succinic anhydrides, nitriles, epoxides, boron compounds, and phosphorus compounds. References detailing such treatment are listed in U.S. Pat. No. 4,654,403.

In particular, the succinimide dispersants as used in the disclosed technology may optionally, in one embodiment, be borated and as such would contain boron and supply boron to the lubricant formulation. Borated dispersants may be prepared by borating using a variety of agents such as any of the various forms of boric acid (including metaboric acid, HBO2, orthoboric acid, H3BO3, and tetraboric acid, H2B4O7), boric oxide, boron trioxide, and alkyl borates. In one embodiment the borating agent is boric acid which may be used alone or in combination with other borating agents.

The borated dispersant may be prepared by blending the boron compound and a succinimide dispersant and heating them at a suitable temperature, typically 80° C. to 250° C., 90° C. to 230° C., or 100° C. to 210° C., until the desired reaction has occurred. An inert liquid may be used in performing the reaction. The liquid may include toluene, xylene, chlorobenzene, dimethylformamide, or mixtures thereof. The boron-containing succinimide dispersant may have a boron content of 0.5 to 1.0 weight percent, or 0.6 to 0.9, or 0.54 to 0.85, or 0.56 to 0.83 weight percent.

The borated succinimide dispersant may also be a product containing additional functionality by post treating, for instance, prepared by heating together:

(i) a succinimide dispersant;

(ii) a borating agent; and (ii) optionally 2,5-dimercapto-1,3,4-thiadiazole or a hydrocarbyl-substituted 2,5-dimercapto-1,3,4-thiadiazole ("DMTD"), or oligomers thereof;

(iv) optionally a dicarboxylic acid of an aromatic compound selected from the group consisting of 1,3 diacids and 1,4 diacids; and (v) optionally a phosphorus acid compound, said heating being sufficient to provide a product of (i), (ii), and optionally (iii), (iv) and/or (v), the product being which is soluble in an oil of lubricating viscosity. In one embodiment the borated succinimide dispersant is further treated with a dimercaptothiadiazole.

The dispersant component may also comprise a mixture of separate dispersant species, including an untreated (non-borated) succinimide dispersant, a borated succinimide dispersant, a DMTD-treated dispersant, and a terephthalic acid-treated dispersant. Alternatively, some or all of the post treatments may be applied to some or all of the succinimide dispersant species. In one embodiment, for example, some or all of the succinimide dispersant may be borated and treated with a dimercaptothiadiazole and optionally further with terephthalic acid. In one embodiment there may be a mixture of a borated succinimide dispersant and a borated and DMTD-treated dispersant. In certain embodiments the dispersant component may comprise 1 to 4 percent by weight of a borated succinimide dispersant that is not treated with a dimercaptothiadiazole and 0.1 to 1.5 percent weight of a borated succinimide dispersant that is treated with a dimercaptothiadiazole.

The components to prepare the post-treated succinimide dispersant may be combined and reacted in any order. In particular, the borating agent may be a pre-treatment process or a post-treatment process. Thus, for instance, boric acid (and optionally also phosphoric acid) may be reacted with a dispersant substrate in one step, and thereafter the intermediate borated dispersant may be reacted with the mercaptothiadiazole and the dicarboxylic acid of an aromatic compound. Alternatively, the dispersant substrate, dicarboxylic acid of an aromatic compound and mercapthothiadiazole may be first reacted, and then the product treated with a borating agent (and optionally with phosphoric acid, a phosphorus acid). In yet another variation, a phosphorylated succinimide dispersant may be prepared by reacting a phosphorus acid with a hydrocarbyl-substituted succinic anhydride to prepare a mixed anhydride-acid precursor, and then reacting the precursor with a polyamine to form a phosphorus-containing dispersant. The phosphorus-containing dispersant may thereafter be reacted with the dicarboxylic acid of an aromatic compound and mercaptothiadiazole; and with the borating agent.

The components are typically reacted by heating the borating agent and optionally the other agents with the dispersant substrate at a sufficient time and temperature to assure solubility of resulting product, typically 80-200° C., or 90-180° C., or 120-170° C., or 150-170° C. The time of reaction is typically at least 0.5 hours, for instance, 1-24 hours, 2-12 hours, 4-10 hours, or 6-8 hours.

The amount of the succinimide dispersant component (or alternatively of specifically the boron-containing succinimide dispersant) in a fully formulated lubricant of the present technology, if it is present, may be at least 0.1% of the lubricant composition, or at least 0.3% or 0.5% or 1% or 1.5%, and in certain embodiments at most 9% or 8% or 6% or 4% or 3% or 2% by weight, such as 1.1 to 5.5 or 1.0 to 3.5 percent by weight. The amount of boron provided to the lubricant formulation by the borated succinimide dispersant component may be 0 to 270 parts per million by weight, or from 30, 50, 60, 70 or 100 ppm up to 270, 250, 225, 200, 180, or 140 ppm. In certain embodiments the succinimide dispersant component may provide about 10 to about 250 parts per million by weight, or 20 to 200, or 50 to 150 ppm, sulfur to the composition by means of the presence of a dimercaptothiadiazole moiety present therewith.

The lubricant compositions of the disclosed technology may also include one or more foam inhibitors. Anti-foam agents used to reduce or prevent the formation of stable foam include silicones, fluorosilicones, or organic polymers such as acrylate polymers, fluoroacrylate polymers, or fluoromethacrylate polymers. Examples of these and additional anti-foam compositions are described in "Foam Control Agents," by Henry T. Kerner (Noyes Data Corporation, 1976), pages 125-162. They may typically be present in amounts of 20 to 250 or 50 to 200 parts per million (excluding diluent). Various combinations of antifoam agents may be used: for example, a first anti-foam agent, being derived from a first anti-foam composition comprising a polydimethyl siloxane dispersed or dissolved in an aromatic oil or a naphthenic hydrocarbon solvent, the first anti-foam composition having a kinetic viscosity at 25° C. (absent solvent) in the range from 10,000 to 50,000 mm2/s; a second anti-foam agent being comprising a polydimethyl siloxane dispersed or dissolved in an aromatic oil or a naphthenic hydrocarbon solvent and having a kinetic viscosity at 25° C. (absent solvent) in the range from 80,000 to 120,000 mm2/s; and a third anti-foam agent comprising a fluorinated polysiloxane dispersed or dissolved in an aliphatic solvent or a solvent comprising a ketone (e.g., aliphatic ketone) having 5 to 16 carbon atoms and having a kinematic viscosity at 25° C. (absent solvent) in the range from 50 to 500 mm2/s. Such a mixture of antifoam agents is disclosed in U.S. Pat. No. 9,309,480, Loop et al., Apr. 12, 2016.

Friction modifiers, in the context of automatic transmission lubricants, are materials designed to provide a high, stable coefficient of friction to lubricated clutch plates, typically comprising mating plates of metal (iron) and a non-metal composition such as a cellulosic surface. Friction modifiers are well known to those skilled in the art. A list of friction modifiers that may be used is included in U.S. Pat. Nos. 4,792,410, 5,395,539, 5,484,543 and 6,660,695. U.S. Pat. No. 5,110,488 discloses metal salts of fatty acids and especially zinc salts, useful as friction modifiers. A list of friction modifiers that may be used may include borated alkoxylated fatty amines; fatty acid amides; metal salts of fatty acids; fatty epoxides; sulfurized olefins; fatty imidazolines; fatty amines; condensation products of carboxylic acids and polyalkylene-polyamines; glycerol esters; metal salts of alkyl salicylates; borated glycerol esters; amine salts of alkylphosphoric acids; alkoxylated fatty amines; ethoxylated alcohols; oxazolines; imidazolines; hydroxyalkyl amides; polyhydroxy tertiary amines; and mixtures of two or more thereof.

Non-borated fatty epoxides may also be useful as supplemental friction modifiers.

Borated amines that may be used are disclosed in U.S. Pat. No. 4,622,158. Borated amine friction modifiers (including borated alkoxylated fatty amines) may be prepared by the reaction of a boron compounds, as described above, with the corresponding amines, including simple fatty amines and hydroxy containing tertiary amines. The amines useful for preparing the borated amines may include commercial alkoxylated fatty amines known by the trademark "ETHOMEEN" and available from Akzo Nobel, such as bis[2-hydroxyethyl]-cocoamine, polyoxyethylene-[10]cocoamine, bis[2-hydroxyethyl]soyamine, bis[2-hydroxyethyl]-tallowamine, polyoxyethylene-[5]tallowamine, bis[2-hydroxyethyl]oleylamine, bis[2-hydroxyethyl] octadecylamine, and polyoxyethylene[15]octadecylamine. Such amines are described in U.S. Pat. No. 4,741,848.

Alkoxylated fatty amines and fatty amines themselves (such as oleylamine) may be useful as friction modifiers. These amines are commercially available.

Both borated and unborated fatty acid esters of glycerol may be used as friction modifiers. Borated fatty acid esters of glycerol may be prepared by borating a fatty acid ester of glycerol with a boron source such as boric acid. Fatty acid esters of glycerol themselves may be prepared by a variety of methods well known in the art. Many of these esters, such as glycerol monooleate and glycerol tallowate, are manufactured on a commercial scale. Commercial glycerol monooleates may contain a mixture of 45% to 55% by weight monoester and 55% to 45% by weight diester.

Fatty acids may be used in preparing the above glycerol esters; they may also be used in preparing their metal salts, amides, and imidazolines, any of which may also be used as friction modifiers. The fatty acids may contain 6 to 24 carbon atoms, or 8 to 18 carbon atoms. A useful acid may be oleic acid.

The amides of fatty acids may be those prepared by condensation with ammonia or with primary or secondary amines such as diethylamine and diethanolamine. Fatty imidazolines may include the cyclic condensation product of an acid with a diamine or polyamine such as a polyethylenepolyamine. In one embodiment, the friction modifier may be the condensation product of a C8 to C24 fatty acid with a polyalkylene polyamine, for example, the product of isostearic acid with tetraethylenepentamine. The condensation products of carboxylic acids and polyalkyleneamines may be imidazolines or amides.

The fatty acid may also be present as its metal salt, e.g., a zinc salt. These zinc salts may be acidic, neutral, or basic (overbased). These salts may be prepared from the reaction of a zinc containing reagent with a carboxylic acid or salt thereof. A useful method of preparation of these salts is to react zinc oxide with a carboxylic acid. Useful carboxylic acids are those described hereinabove. Suitable carboxylic acids include those of the formula RCOOH where R is an aliphatic or alicyclic hydrocarbon radical. Among these are those wherein R is a fatty group, e.g., stearyl, oleyl, linoleyl, or palmityl. Also suitable are the zinc salts wherein zinc is present in a stoichiometric excess over the amount needed to prepare a neutral salt. Salts wherein the zinc is present from 1.1 to 1.8 times the stoichiometric amount, e.g., 1.3 to 1.6 times the stoichiometric amount of zinc, may be used. These zinc carboxylates are known in the art and are described in U.S. Pat. No. 3,367,869. Metal salts may also include calcium salts. Examples may include overbased calcium salts.

Sulfurized olefins are also well known commercial materials used as friction modifiers. A suitable sulfurized olefin is one which is prepared in accordance with the detailed teachings of U.S. Pat. Nos. 4,957,651 and 4,959,168. Described therein is a cosulfurized mixture of 2 or more reactants selected from the group consisting of at least one fatty acid ester of a polyhydric alcohol, at least one fatty acid, at least one olefin, and at least one fatty acid ester of a monohydric alcohol. The olefin component may be an aliphatic olefin, which usually will contain 4 to 40 carbon atoms. Mixtures of these olefins are commercially available. The sulfurizing agents useful in the process of the present invention include elemental sulfur, hydrogen sulfide, sulfur halide plus sodium sulfide, and a mixture of hydrogen sulfide and sulfur or sulfur dioxide.

Metal salts of alkyl salicylates include calcium and other salts of long chain (e.g. C12 to C16) alkyl-substituted salicylic acids.

Amine salts of alkylphosphoric acids include salts of oleyl and other long chain esters of phosphoric acid, with amines such as tertiary-aliphatic primary amines, sold under the tradename Primene™.

Eighty-five percent phosphoric acid is a suitable material for addition to the fully-formulated compositions to increase frictional properties and can be included at a level of 0.01-0.3 weight percent based on the weight of the composition, such as 0.03 to 0.2 or to 0.1 percent.

The amount of supplemental friction modifier, if it is present, may be 0.01 to 10 or 5 percent by weight of the lubricating composition, 0.1 to 2.5 percent by weight of the lubricating composition, such as 0.1 to 2.0, 0.2 to 1.75, 0.3 to 1.5 or 0.4 to 1 percent. In some embodiments, however, the amount of friction modifier is present at less than 0.2 percent or less than 0.1 percent by weight, for example, 0.01 to 0.1 percent.

Antioxidants encompass phenolic antioxidants, which may be hindered phenolic antioxidants, one or both ortho positions on a phenolic ring being occupied by bulky groups such as t-butyl. The para position may also be occupied by a hydrocarbyl group or a group bridging two aromatic rings. In certain embodiments the para position is occupied by an ester-containing group, such as, for example, an antioxidant of the formula

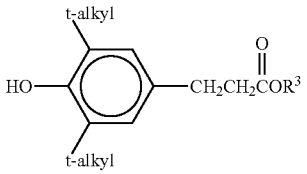

wherein $R^3$ is a hydrocarbyl group such as an alkyl group containing, e.g., 1 to 18 or 2 to 12 or 2 to 8 or 2 to 6 carbon atoms; and t-alkyl can be t-butyl. Such antioxidants are described in greater detail in U.S. Pat. No. 6,559,105.

Antioxidants also include aromatic amines. In one embodiment, an aromatic amine antioxidant can comprise an alkylated diphenylamine such as nonylated diphenylamine or a mixture of a di-nonylated and a mono-nonylated diphenylamine.

Antioxidants also include sulfurized olefins such as mono- or disulfides or mixtures thereof. These materials generally have sulfide linkages of 1 to 10 sulfur atoms, e.g., 1 to 4, or 1 or 2. Materials which can be sulfurized to form the sulfurized organic compositions of the present invention include oils, fatty acids and esters, olefins and polyolefins made thereof, terpenes, or Diels-Alder adducts. Details of methods of preparing some such sulfurized materials can be found in U.S. Pat. Nos. 3,471,404 and 4,191,659.

Molybdenum compounds can also serve as antioxidants, and these materials can also serve in various other functions, such as antiwear agents or friction modifiers. U.S. Pat. No. 4,285,822 discloses lubricating oil compositions containing a molybdenum- and sulfur-containing composition prepared by combining a polar solvent, an acidic molybdenum compound and an oil-soluble basic nitrogen compound to form a molybdenum-containing complex and contacting the complex with carbon disulfide to form the molybdenum- and sulfur-containing composition.

Typical amounts of antioxidants will, of course, depend on the specific antioxidant and its individual effectiveness, but illustrative total amounts can be 0.01 to 5 percent by weight or 0.15 to 4.5 percent or 0.2 to 4 percent.

Detergents are typically overbased materials, otherwise referred to as over-based or superbased salts, which are generally homogeneous Newtonian systems having by a metal content in excess of that which would be present for neutralization according to the stoichiometry of the metal and the detergent anion. The amount of excess metal is commonly expressed in terms of metal ratio, that is, the ratio of the total equivalents of the metal to the equivalents of the acidic organic compound. Overbased materials are prepared by reacting an acidic material (such as carbon dioxide) with an acidic organic compound, an inert reaction medium (e.g., mineral oil), a stoichiometric excess of a metal base, and a promoter such as a phenol or alcohol. The acidic organic material will normally have a sufficient number of carbon atoms, to provide oil-solubility.

Overbased detergents may be characterized by Total Base Number (TBN, ASTM D2896), the amount of strong acid needed to neutralize all of the material's basicity, expressed as mg KOH per gram of sample. Since overbased detergents are commonly provided in a form which contains diluent oil, for the purpose of this document, TBN is to be recalculated to an oil-free basis by dividing by the fraction of the detergent (as supplied) that is not oil. Some useful detergents may have a TBN of 100 to 800, or 150 to 750, or, 400 to 700.

The metal compounds useful in making the basic metal salts are generally any Group 1 or Group 2 metal compounds (CAS version of the Periodic Table of the Elements). Examples include alkali metals such as sodium, potassium, lithium, copper, magnesium, calcium, barium, zinc, and cadmium. In one embodiment the metals are sodium, magnesium, or calcium. The anionic portion of the salt can be hydroxide, oxide, carbonate, borate, or nitrate.

In one embodiment the lubricant can contain an overbased sulfonate detergent. Suitable sulfonic acids include sulfonic and thiosulfonic acids, including mono- or polynuclear aromatic or cycloaliphatic compounds. Certain oil-soluble sulfonates can be represented by R2-T-(SO3-)a or R3-(SO3-)b, where a and b are each at least one; T is a cyclic nucleus such as benzene or toluene; R2 is an aliphatic group such as alkyl, alkenyl, alkoxy, or alkoxyalkyl; (R2)-T typically contains a total of at least 15 carbon atoms; and R3 is an aliphatic hydrocarbyl group typically containing at least 15 carbon atoms. The groups T, R2, and R3 can also contain other inorganic or organic substituents. In one embodiment the sulfonate detergent may be a predominantly linear alkylbenzenesulfonate detergent having a metal ratio of at least 8 as described in paragraphs to of US Patent Application 2005065045.

Another overbased material is an overbased phenate detergent. The phenols useful in making phenate detergents can be represented by (R1)a-Ar-(OH)b, where R1 is an aliphatic hydrocarbyl group of 4 to 400 or 6 to 80 or 6 to 30 or 8 to 25 or 8 to 15 carbon atoms; Ar is an aromatic group such as benzene, toluene or naphthalene; a and b are each at least one, the sum of a and b being up to the number of displaceable hydrogens on the aromatic nucleus of Ar, such as 1 to 4 or 1 to 2. Phenate detergents are also sometimes provided as sulfur-bridged species.

In one embodiment, the overbased material is an overbased saligenin detergent. Overbased saligenin detergents are commonly overbased magnesium salts which are based on saligenin derivatives. Saligenin detergents are disclosed in greater detail in U.S. Pat. No. 6,310,009, with special reference to their methods of synthesis (Column 8 and Example 1).

Salixarate derivatives and methods of their preparation are described in greater detail in U.S. Pat. No. 6,200,936 and PCT Publication WO 01/56968. It is believed that the salixarate derivatives have a predominantly linear, rather than macrocyclic, structure, although both structures are intended to be encompassed by the term "salixarate." Overbased glyoxylic detergents and their methods of preparation are disclosed in greater detail in U.S. Pat. No. 6,310,011 and references cited therein. The overbased detergent can also be an overbased salicylate, e.g., an alkali metal or alkaline earth metal salt of a substituted salicylic acid. Overbased salicylate detergents and their methods of preparation are disclosed in U.S. Pat. Nos. 4,719,023 and 3,372,116. Other overbased detergents can include overbased detergents having a Mannich base structure, as disclosed in U.S. Pat. No. 6,569,818.

In certain embodiments, the hydrocarbyl substituents on hydroxy-substituted aromatic rings in the above detergents (e.g., phenate, saligenin, salixarate, glyoxylate, or salicylate) are free of or substantially free of C12 aliphatic hydrocarbyl groups (e.g., less than 1%, 0.1%, or 0.01% by weight of the substituents are C12 aliphatic hydrocarbyl groups). In some embodiments such hydrocarbyl substituents contain at least 14 or at least 18 carbon atoms.

The amount of the overbased detergent, in the formulations of the present technology, if it is present, may typically be at least 0.6 weight percent on an oil-free basis, or 0.7 to 5 weight percent or 1 to 3 weight percent or 0.05 to 0.55 weight percent. Either a single detergent or multiple detergents can be present. As alternatively expressed, the amount of overbased calcium detergent may be an amount suitable to deliver 110 to 550 parts per million by weight, or 175 or 400 or 175 to 300 ppm.

Corrosion inhibitors often refer to copper (or "yellow metal") corrosion inhibitors. Such materials include triazole compounds such as tolyltriazole, derivatives of tolyltriazole, imidazoline compounds, thiadiazoles, carboxylic acids and their salts or esters, and alkanolamines.

Antiwear agents may also be included, in addition to or supplemental to the phosphorus esters described in detail above. Examples include phosphorus-containing antiwear/extreme pressure agents such as phosphoric acid esters and salts thereof, phosphorus-containing carboxylic acids, esters, ethers, and amides; and phosphites. In certain embodiments a phosphorus antiwear agent may be present in an amount to deliver 0.01 to 0.2 or 0.015 to 0.15 or 0.02 to 0.1 or 0.025 to 0.08 percent phosphorus. Non-phosphorus-containing anti-wear agents include borate esters (including borated epoxides), dithiocarbamate compounds, molybdenum-containing compounds, and sulfurized olefins.

Extreme pressure (EP) agents include some of the materials listed elsewhere herein as well as other sulfur- and chlorosulfur-containing EP agents, chlorinated hydrocarbon EP agents, and phosphorus EP agents. Examples of such EP agents include chlorinated wax; sulfurized olefins (such as sulfurized isobutylene), organic sulfides and polysulfides such as dibenzyldisulfide, bis-(chlorobenzyl)disulfide, dibutyl tetrasulfide, sulfurized methyl ester of oleic acid, sulfurized alkylphenol, sulfurized dipentene, sulfurized terpene, and sulfurized Diels-Alder adducts; phosphosulfurized hydrocarbons such as the reaction product of phosphorus sulfide with turpentine or methyl oleate; phosphorus esters such as the dihydrocarbon and trihydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene-substituted phenol phosphite; metal thiocarbamates such as zinc dioctyldithiocarbamate; amine salts of alkyl and dialkylphosphoric acids or derivatives including, for example, the amine salt of a reaction product of a dialkyldithiophosphoric acid with propylene oxide and subsequently followed by a further reaction with P2O5; and mixtures thereof (as described in U.S. Pat. No. 3,197,405).

Seal swell agents include oil-soluble esters and oil-soluble sulfones, sulfolanes, such as isodecyl sulfolane, benzyl esters, lactones, nitriles, phenolic materials, or phthalate esters.

As used herein, the term "condensation product" is intended to encompass esters, amides, imides and other such materials that may be prepared by a condensation reaction of an acid or a reactive equivalent of an acid (e.g., an acid halide, anhydride, or ester) with an alcohol or amine, irrespective of whether a condensation reaction is actually performed to lead directly to the product. Thus, for example, a particular ester may be prepared by a transesterification reaction rather than directly by a condensation reaction. The resulting product is still considered a condensation product.

The amount of each chemical component described is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

- hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);
- substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, or no more than one, non-hydrocarbon substituent will be present for every ten carbon atoms in the hydrocarbyl group; alternatively, there may be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

The invention herein provides a method of minimizing electrically conductive deposits in an electrically conducting apparatus by lubricating the apparatus with the lubricant described herein (namely a lubricant containing an oil of lubricating viscosity and from 0.3 to 1 wt. % borate ester in some instances, or from 0.3 to 1 wt. % borate ester and from 0.01 to 1.0 wt. % of a thiadiazole compound in other instances). In an embodiment, the electrically conducting apparatus may be, for example, an electrical motor.

In a particular embodiment, the electrically conducting apparatus may be an electrical motor in the driveline of an electrified automobile. The method of lubricating such an electrical motor can entail operating the driveline device under normal operating conditions and employing the lubricant to lubricate or cool the electric motor. The lubricant may be dripped onto the motor coils of the electric motor. In embodiments, the lubricant may be sprayed onto the motor coils. The coils may also be immersed in the lubricant.

In one embodiment, the electrical motor may be a part of the transmission of the automobile. It may be useful wherein the automatic transmission contains a bearing, such as a needle bearing, that is lubricated by the lubricant composition.

In another embodiment the motor may be a part of a driveline device having at least two gears as in a gearbox of a vehicle (e.g., a manual transmission) or in an axle or differential, or in other driveline power transmitting devices. The driveline device may also include bearings. The rolling elements of the bearings may be cylindrical or ball in design. Lubricated gears may include amboid, or spiral bevel, or more commonly hypoid gears, such as those for example in a drive axle. The axles may have a gear ratio of 2:1 to 8:1, and the ring gear maybe be approximately 13 to 64 cm in diameter. The axle may incorporate an open differential or some type of traction enabling device. The axle may be part of a drivetrain with one or more drive axles, such as a tandem or tridem design, in which the axles may be coupled together with a power divider. Application of these axles includes light, medium and heavy duty vehicles (e.g. vocational or line haul service), and could be used on or off highway. The axle may be from a traditional petroleum powered vehicle, may be from an electrically driven vehicle, or a hybrid thereof. The electrically driven axle can combine an electric motor, power electronics and transmission in a unit directly powering the vehicle's axle.

The lubricant can lubricate the other components of the driveline device and therefore should be able to meet the other aspects expected of it in normal operation of the driveline device.

In addition, the method provided herein can maintain a wear rating in the electrically conducting apparatus according to ASTM D5182 at 150° C. of greater than 10.

The advantages and uses of the disclosed technology may be better understood with reference to the following examples.

EXAMPLES

Two commercial lubricants were evaluated in the new conductive layer deposit test. Lubricant 1 is commercially available as Evogen™ 5191SA and Lubricant 2 is ZF Lifeguard 8. Note that Lubricant 1 contains a significantly reduced level of sulfur compared to Lubricant 2 (See Table 1.)

For each fluid, ten copper printed circuit boards (PCB) were arranged into two separate stacked layers, five in the oil solution and five in the vapor space. The fluids tested were contained in a closed, vented vessel heated to 150° C. The fluids were subjected to a 5V current. Conductance(S) measurements were recorded over time for the printed circuit boards both in solution and in the vapor phase. Results of the energized board conductance versus time are shown in Tables 1 and 2. Conductance values are reported in microsiemens (μS).

TABLE 1

Solution phase conductance over time

| | Lubricant 1 | Lubricant 2 |
|---|---|---|
| % S | 0.017 | 0.13 |
| 50 hours | 0.07 | 0.171 |
| 100 hours | 0.07 | 20.4 |
| 200 hours | 0.07 | 286 |
| 300 hours | 0.07 | 284 |
| 400 hours | 0.07 | 295 |

TABLE 2

Vapor phase conductance over time

| | Lubricant 1 | Lubricant 2 |
|---|---|---|
| % S | 0.017 | 0.13 |
| 50 hours | 0.00005 | 00005 |
| 100 hours | 0.00005 | 76.0 |
| 200 hours | 0.00005 | 58.0 |
| 300 hours | 0.00005 | 66.7 |
| 400 hours | 0.00005 | 114.0 |

Lubricant 1 does not form conductive layer deposits as the conductance values for both the solution and vapor phases do not change appreciably. Lubricant 2 showed the formation of conductive deposits in both the solution and vapor phases simultaneously.

Lubricant 1 exhibits no visible deposits formed on the boards at the end of test (EOT) in both the solution and vapor phase. The vapor phase PCB base material has some darkening present. The end of test conductance measurements on all boards are below measurable values.

Lubricant 2 has visible deposits in both the solution and vapor phase. All end of test boards have a greater conductance than that of a fresh PCB.

Lubricant 3 is a fully formulated automatic transmission fluids that was prepared according to the formulation in Table 3 below. The formulation contained in Lubricant 3 was optimized to provide excellent wear protection in the FZG Test for Load Carrying Capacity while maintaining low corrosion of copper in traditional solution phase tests. (See Table 4 Performance Results) When Lubricant 3 was tested to determine performance in the conductive layer deposit test, failing results were observed.

TABLE 3

| | Lubricant 3 | Lubricant 4 | Lubricant 5 | Lubricant 6 |
|---|---|---|---|---|
| Succinimide dispersant | 1.77 | 1.77 | 1.77 | 1.77 |
| Post treated succinimide dispersants | 1.08 | 1.08 | 1.08 | 1.08 |
| P-containing antiwear | 0.34 | 0.34 | 0.34 | 0.34 |
| Hydroxyl containing friction modifiers | 1.1 | 1.1 | 1.1 | 1.1 |
| Ca sulfonate detergents | 0.23 | 0.23 | 0.23 | 0.23 |
| Sulfone seal swell | 0.5 | 0.5 | 0.5 | 0.5 |
| Alkylated aromatic amine | 0.65 | 0.65 | 0.65 | 0.65 |
| polymethacrylate | 0.1 | 0.1 | 0.1 | 0.1 |
| Imidazoline | 0.007 | 0.007 | 0.007 | 0.007 |
| Triazole containing corrosion inhibitors | 0.024 | 0.024 | 0.024 | 0.024 |
| Ester | 0.68 | 0.68 | 0.68 | 0.68 |
| Antifoam | 210 ppm | 330 ppm | 330 ppm | 330 ppm |
| Alkylated Dimercaptothiadiazole (S-1) | 0.09 | 0.07 | 0.07 | 0.08 |
| Dispersant post treated with dimercaptothiadiazole (S-2) | 0.20 | 0.20 | 0.15 | 0.18 |
| Borate ester | 0.1 | 0.1 | 0.1 | 0.3 |

Two components were singled out as potentially harmful to this test due to the presence of sulfur. One was an alkylated dimercaptothiadiazole that typically functions as a corrosion inhibitor and also has the potential to provide EP/antiwear performance (S-1). The second was a post treated dispersant that also contained a dimercaptothiadiazole (S-2). Descriptions of this dispersant can be found in U.S. Pat. No. 4,140,643. Attempts were made to reduce the levels of one or both of these substances in lubricants 4 and 5 in an effort to improve the results obtained in the conductive layer deposit test. However, these were not successful. Surprisingly, the addition of an increased treat rate of borate ester (Lubricant 6), however, allowed a formulation still containing these components to pass the conductive layer deposit test.

TABLE 4

| | Lubricant 3 | Lubricant 4 | Lubricant 5 | Lubricant 6 |
|---|---|---|---|---|
| Sulfur, ppm from S-1 | 324 | 252 | 252 | 288 |
| Sulfur, ppm from S-2 | 124 | 124 | 93 | 109 |
| S-1 + S-2 | 448 | 376 | 345 | 397 |
| Boron, ppm | 88 | 88 | 88 | 142 |

TABLE 4-continued

| | Lubricant 3 | Lubricant 4 | Lubricant 5 | Lubricant 6 |
|---|---|---|---|---|
| Performance Results | | | | |
| FZG, Failure load stage | 12 | 11 | >12 | >12 |
| D130, 3 hrs at 150° C. | 1B | 1B | 2A | 1B |
| Cu in solution (150° C. for 168 hrs) | 34 ppm | 54 ppm | 37 ppm | 38 ppm |
| CLDT, pass/fail | FAIL | FAIL | FAIL | PASS |

Each of the documents referred to above is incorporated herein by reference, including any prior applications, whether or not specifically listed above, from which priority is claimed. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as optionally modified by the word "about." It is to be understood that the upper and lower amount, range, and ratio limits set forth herein may be independently combined. Similarly, the ranges and amounts for each element of the invention can be used together with ranges or amounts for any of the other elements.

As used herein, the transitional term "comprising," which is synonymous with "including," "containing," or "characterized by," is inclusive or open-ended and does not exclude additional, un-recited elements or method steps. However, in each recitation of "comprising" herein, it is intended that the term also encompass, as alternative embodiments, the phrases "consisting essentially of" and "consisting of," where "consisting of" excludes any element or step not specified and "consisting essentially of" permits the inclusion of additional un-recited elements or steps that do not materially affect the essential or basic and novel characteristics of the composition or method under consideration. The expression "consisting of" or "consisting essentially of," when applied to an element of a claim, is intended to restrict all species of the type represented by that element, notwithstanding the presence of "comprising" elsewhere in the claim.

While certain representative embodiments and details have been shown for the purpose of illustrating the subject invention, it will be apparent to those skilled in this art that various changes and modifications can be made therein without departing from the scope of the subject invention. In this regard, the scope of the invention is to be limited only by the following claims.

What is claimed is:

1. A method of minimizing electrically conductive deposits in an electrically conducting apparatus comprising applying to said apparatus a lubricant comprising an oil of lubricating viscosity and from 0.2 to 1.1 wt. % borate ester and 0.6 to 1 percent by weight of a thiadiazole compound, and applying an electric current to the apparatus.

2. The method of claim 1, maintaining a wear rating according to ASTM D5182 at 150C of greater than 10.

3. The method of claim 1 wherein the borate ester comprises formula (I)

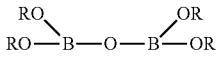

wherein each R individually is 4 to 18 carbon atoms.

4. The method of claim 1 wherein the borate ester comprises formula (II)

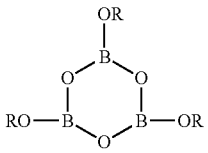

wherein each R individually is 4 to 18 carbon atoms.

5. The method of claim 1 wherein the borate ester comprises formula (III)

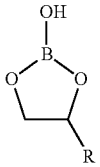

wherein each R individually is 4 to 18 carbon atoms.

6. The method of claim 1 wherein the borate ester comprises formula (IV)

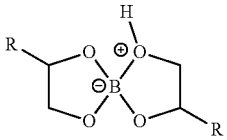

wherein each R individually is 4 to 18 carbon atoms.

7. The method of claim 1 wherein the borate ester comprises formula (V)

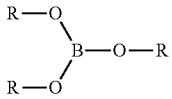

wherein each R individually is 4 to 18 carbon atoms.

8. The method of claim 1 wherein the borate ester comprises formula (VI)

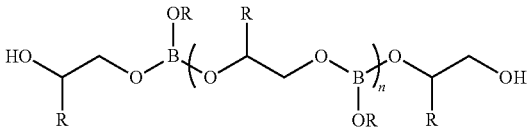

wherein each R individually is 4 to 18 carbon atoms.

9. The method of claim 1 wherein the borate ester comprises tripropyl borate.

10. The method of claim 1 wherein the borate ester comprises tributyl borate.

11. The method of claim 1 wherein the borate ester comprises tripentyl borate.

12. The method of claim 1 wherein the borate ester comprises trihexyl borate.

13. The method of claim 1 wherein the borate ester comprises triheptyl borate.

14. The method of claim 1 wherein the borate ester comprises trioctyl borate.

15. The method of claim 1 wherein the borate ester comprises trinonyl borate.

16. The method of claim 1 wherein the borate ester comprises tridecyl borate.

17. The method of claim 1 wherein the borate ester comprises tri-2-ethylhexyl borate.

18. The method of claim 1 wherein the borate ester is present in the lubricant at 0.25 to 1.1 percent by weight.

* * * * *